US005720390A

United States Patent [19]

Bostelman

[11] Patent Number: 5,720,390

[45] Date of Patent: Feb. 24, 1998

[54] INTERNAL SPACER FOR PACKAGING OF HAZARDOUS MATERIALS

[75] Inventor: Jeffrey A. Bostelman, Oak Brook, Ill.

[73] Assignee: Corrugated Container Corp., Elmhurst, Ill.

[21] Appl. No.: 752,607

[22] Filed: Nov. 19, 1996

[51] Int. Cl.[6] ..... B65D 81/02; B65D 5/50

[52] U.S. Cl. ..... 206/587; 206/434; 206/446; 206/589

[58] Field of Search ..... 206/521, 526, 206/587, 588, 589, 590, 591, 592, 593, 429, 434, 446

[56] References Cited

U.S. PATENT DOCUMENTS

| | | | |
|---|---|---|---|
| 1,352,759 | 9/1920 | Markert . | |
| 1,812,311 | 6/1931 | Wolf | 206/589 |
| 2,125,313 | 8/1938 | Ringler | 206/590 |
| 2,744,622 | 5/1956 | Sparks | 206/590 |
| 2,919,844 | 1/1960 | Anderson . | |
| 3,089,631 | 5/1963 | Tyrseck et al. . | |
| 3,167,235 | 1/1965 | Hailey et al. . | |
| 3,682,597 | 8/1972 | Husch . | |
| 3,709,325 | 1/1973 | Gordon et al. . | |
| 3,987,892 | 10/1976 | Killy . | |
| 4,848,563 | 7/1989 | Robbins | 206/588 |
| 4,865,200 | 9/1989 | Sullivan | 206/594 |
| 5,057,282 | 10/1991 | Linder . | |
| 5,318,753 | 6/1994 | Honda . | |
| 5,335,846 | 8/1994 | Smith et al. | 206/594 |
| 5,462,171 | 10/1995 | Moog et al. . | |

*Primary Examiner*—Paul T. Sewell
*Assistant Examiner*—Luan K. Bui
*Attorney, Agent, or Firm*—Jefferson Perkins

[57] ABSTRACT

A spacer (30) for vessels of hazardous materials is formed of a single sheet of cardboard and includes a top panel 32 and a bottom panel 36. The top panel 32 and the bottom panel 36 are spaced from the top and the bottom of the shipping carton, respectively, by upwardly and downwardly projecting members (70, 72, 74, 88, 90, 92, 106, 108, 110, 134). When assembled, ears 120 and 124 fold over the top panel 32 and engage diagonal slots 50 and 52, thereby providing rigidity to the structure.

22 Claims, 5 Drawing Sheets

INTERNAL SPACER FOR PACKAGING OF HAZARDOUS MATERIALS

TECHNICAL FIELD OF THE INVENTION

This invention relates in general to the packaging of goods, and more particularly to spacers for the packaging of vessels of hazardous fluid materials.

BACKGROUND OF THE INVENTION

In recent years, there has been heightened environmental concern over the handling and transport of hazardous materials. In fact, the term "hazardous" has expanded. The Environmental Protection Agency now considers such commonplace fluids as paint to be "hazardous", which therefore require special packaging for shipment in such vehicles as trucks and freight cars. The present conventional practice is to ship such fluid containers using unitary melt-blown polystyrene (some of which is sold under the mark "STYROFOAM") inserts inside of a cardboard carton or the like. A number of cylindrical holes equivalent to the number of cylindrical cans to be shipped are formed in the polystyrene packing unit. Melt-blown polystyrene is now also considered to be environmentally objectionable, and the industry has therefore sought simple and inexpensive replacements for this type of packing.

One such solution is shown in FIG. 1 in an isometric view. The illustrated prior art can spacer 10 is made out of a single blank of cardboard and includes a top panel 12, an end panel 14, a bottom panel 16 and a second side or end panel 18. A plurality of holes 20 is formed in the top panel 12 which, when the spacer is put into an assembled condition, aligns with a like plurality of holes 22 in the bottom panel 16. An upstanding flap 24 loosely fits within a notch 26 to form a very weak and insecure closure.

A principal problem of this spacer 10 is that panel 16 will sit on the bottom of the cardboard carton in which the spacer 10 is designed to be put. This makes the bottom panel 16 of little use in effectively spacing or bracing cans of, e.g., paint, apart from each other; the only truly operational spacing element is top panel 12.

Other cardboard spacing elements having been known in the art, but these tend to be complicated, of several pieces and/or expensive to manufacture. U.S. Pat. No. 2,919,844 illustrates a carton for cups having two spacer panels 3 and 9, but there is no attempt to space the top panel 3 away from the top of any enclosing carton. U.S. Pat. No. 3,167,235 issued to H. T. Hailey et al. discloses a single-blank carton, including several panels of material, with intermediate spacing panels; still, the method of assembling together and securing the Hailey carton is less than optimum. U.S. Pat. No. 3,682,597 issued to Husch discloses a double-panel spacer that depends on the sidewalls of the container in which it sits to remain together. U.S. Pat. No. 5,462,171 illustrates a set of complex honeycomb spacers for packing a can of hazardous material. Even in view of these and other prior art devices, there continues to exist a need for an inexpensive, easy to assemble spacing unit for vessels of hazardous materials.

SUMMARY OF THE INVENTION

Accordingly, the invention provides a spacer for containers or vessels of hazardous material made of a single sheet of cut and scored material, such as cardboard. The spacer includes a top panel, a first end panel, a bottom panel, and a second end panel. A number of holes are formed in the top and bottom panels which, when the spacer is in an assembled condition, are preferably aligned with each other and are sized to receive containers of hazardous materials, such as paint cans. Bodies of the end panels act to space the top and bottom panels apart from each other, and further have upwardly and downwardly extending members or projections which space the top and bottom panels from the top of the packaging carton and from the bottom of the packaging carton. Therefore, both the top and bottom panels occupy positions within the carton that are intermediate the top and the bottom, and both panels are therefore available to brace the containers against horizontal motion. Once of the end panels also has a fastener for affixation to the top panel to assemble the spacer. In a preferred embodiment, this fastener is a flap of the end panel which extends beyond the top panel and which has ears that are bent inwardly to secure to slots in the top panel. This upwardly extending piece also serves as a member which spaces the top spacer panel from the top of the shipping carton.

A principal technical advantage of the invention is its provision of a single-blank hazardous material container spacer which is inexpensive to manufacture and easy to assemble, yet which provides effective bracing of the containers from each other and from the sidewalls of the shipping carton at two vertical locations. A further technical advantage is the use of one of the vertical spacing elements as an affixation element.

BRIEF DESCRIPTION OF THE DRAWINGS

Further aspects of the invention and their technical advantages will be discerned from the following detailed description when taken in conjunction with the drawings, in which.

DETAILED DESCRIPTION OF THE INVENTION

Figure 1:
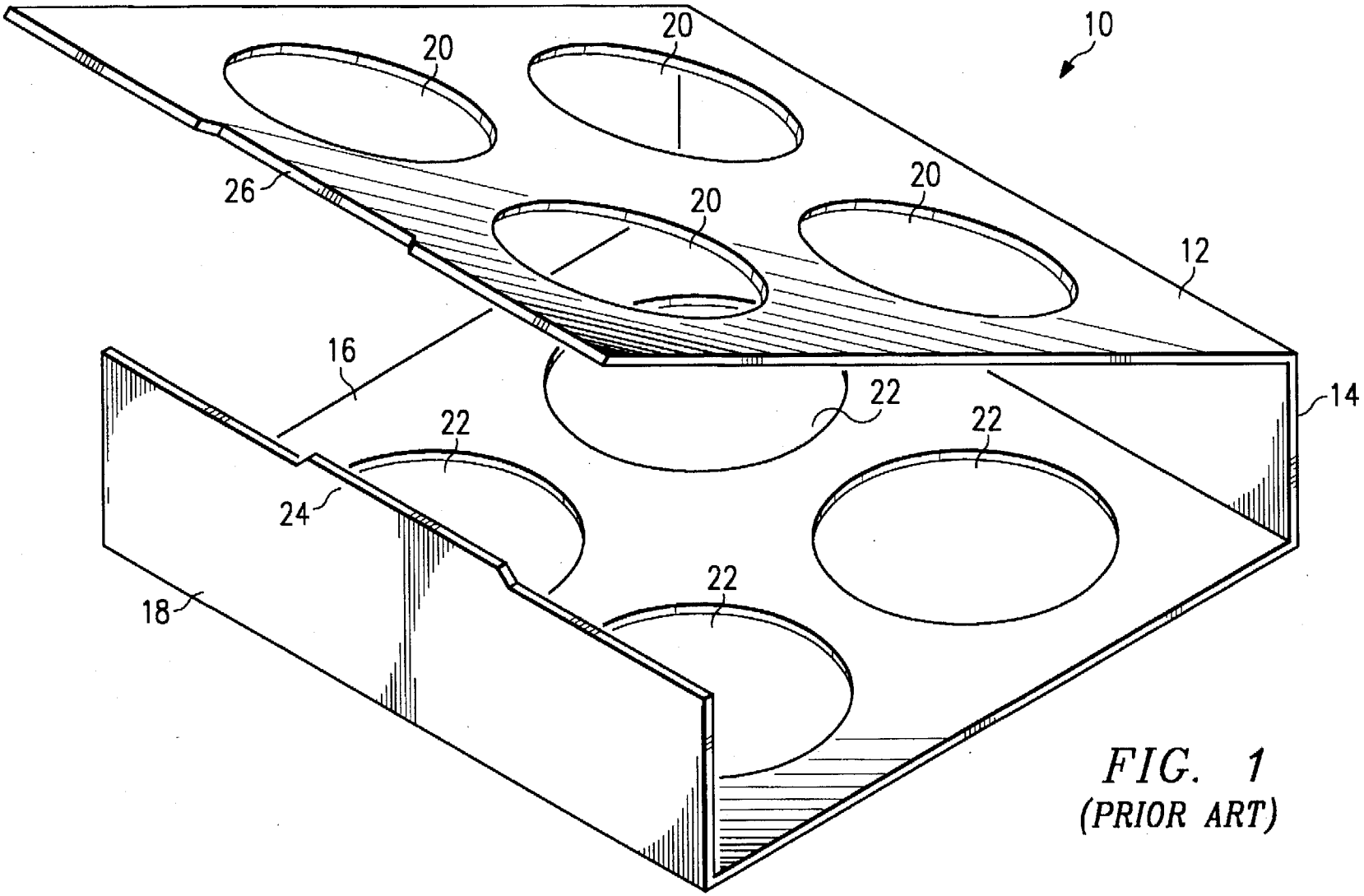
FIG. 1 (PRIOR ART)
FIG. 1 is an isometric view of a hazardous container spacer element according to the prior art.
Figure 2:
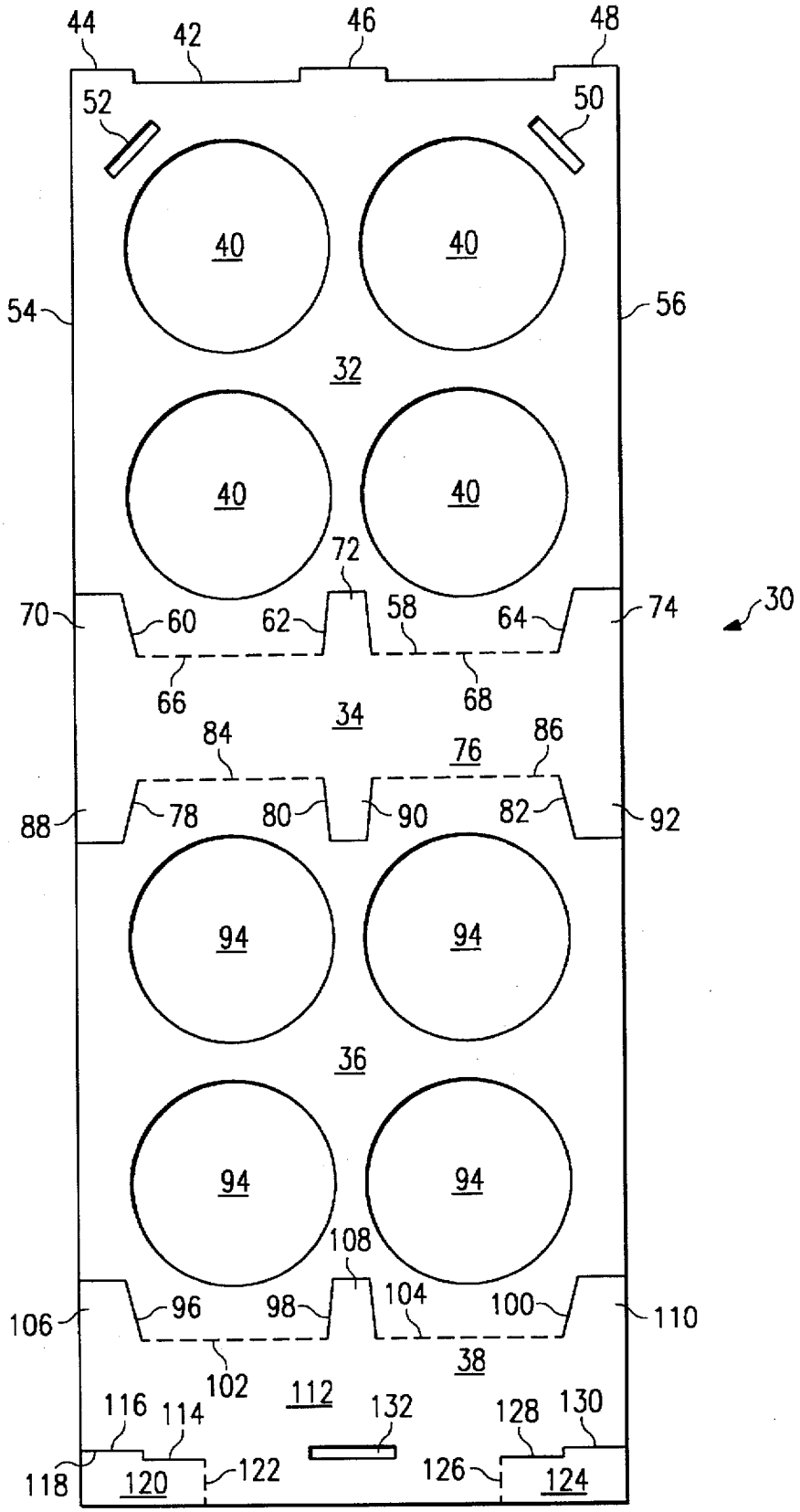
FIG. 2 is a plan view of a hazardous material spacer element according to the invention, in a flat, unassembled condition.
Figure 3:
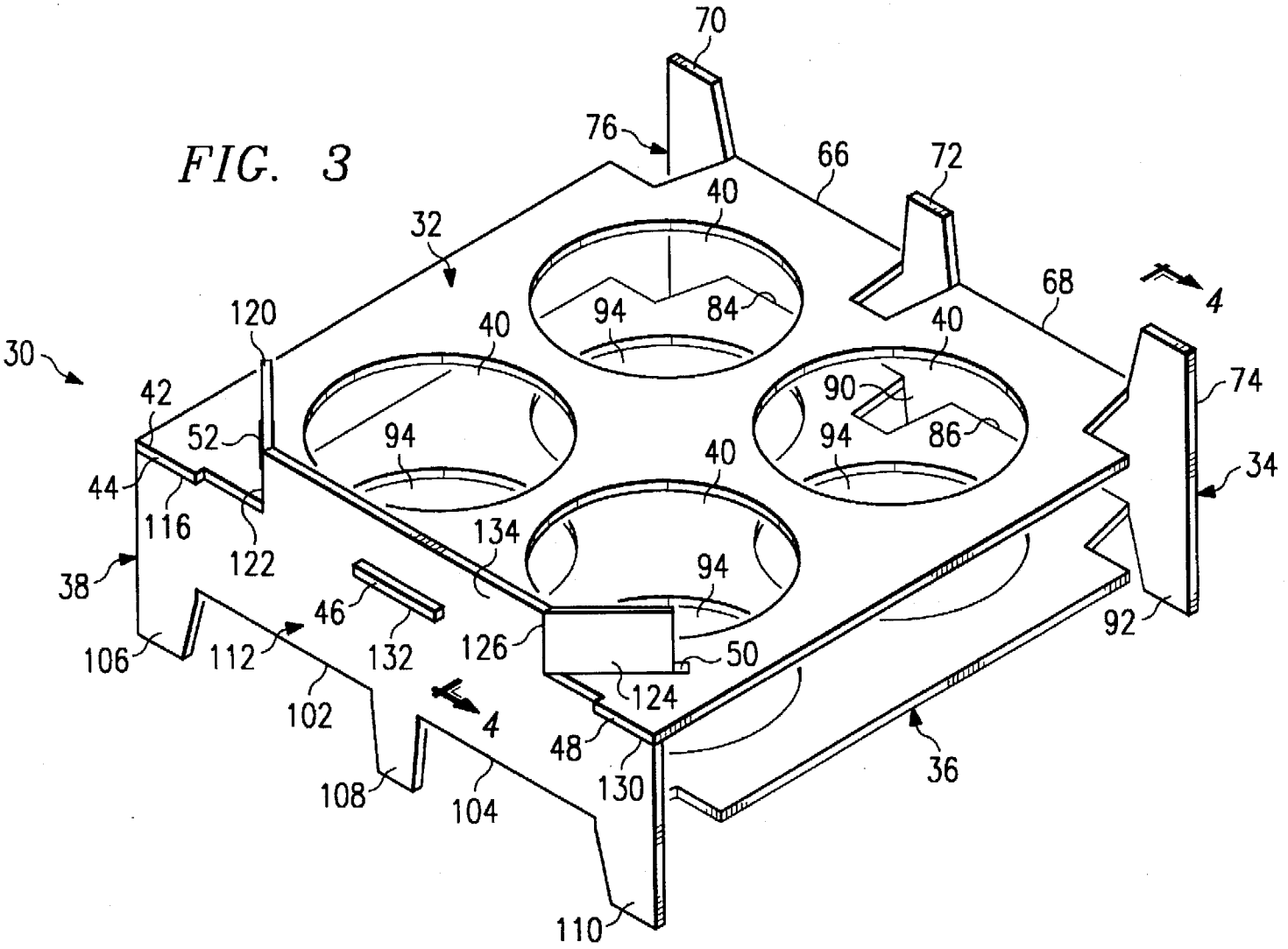
FIG. 3 is an isometric view of the spacer shown in FIG. 2, but in an assembled condition.

Referring to FIGS. 2 and 3, a spacer indicated generally at 30 is shown. Spacer 30 includes a top panel 32, a first side or end panel 34, a bottom panel 36, and a second side or end panel 38. The top panel 32 has a plurality of holes 40 that are formed in it in spaced relation to each other and spaced away from each lateral or side margin of the top panel 32 as well as the ends of panel 32. While holes 40 are illustrated to be four in number and circular in shape, the size and number of these holes 40 can be varied according to the vessel of hazardous materials that they are intended to brace from lateral (or vertical) forces. Thus, the holes 40 can be square, hexagonal, or even take an irregular form, and may be indentations instead of holes, as the invention has application to any hazardous or fragile object requiring shipment by a common carrier. Holes 40 can be similarly or differently sized. Spacers 30 can be devised for one, two, three, four, six or nine vessels or objects, or any other number as may be convenient to ship in a single carton.

The panel 32 has an end margin 42 that has a plurality of extending tabs 44–48. Panel 32 also has a pair of diagonal slots 50 and 52 which are positioned between the outer comers of end margin 42 and respective container holes 40. Panel 32 has straight lateral side margins 54 and 56 which are collinear with the side margins of the remaining panels of the spacer 30. The fourth lateral margin or end 58 of the panel 32 is formed by a combination of cut lines 60, 62 and 64 and a pair of fold or score lines 66 and 68. Cut line 60 forms the outer margin of an upstanding Vertical spacing member 70. Similarly, cut lines 62 and 64 form the outer margins of upstanding vertical spacing members 72 and 74, respectively. It is preferred that the cut lines 60, 62 and 64 be tapered away from the fold or score lines 66 and 68 for ease and integrity of separation from panel 32.

Score lines 66 and 68 join the top panel 32 to the first end panel 34. A main body 76 of the first end panel 34 occupies a rectangular space in between the top panel 32 and the bottom panel 36. The join between panels 34 and 36 is a mirror image of the join between panels 32 and 34; cut lines 78, 80 and 82 are spaced apart by fold or score lines 84 and 86. The cut lines 78, 80 and 82 respectively form downwardly extending vertical spacing members or projections 88, 90 and 92. Similar to upwardly extending spacing members 70, 72 and 74, the outer margins of downwardly extending members 88, 90 and 92 are tapered away from the fold lines 84 and 86 for ease and integrity of separation from panel 36.

The bottom panel 36 has a plurality of holes 94, which in the illustrated embodiment are aligned with, and match in number and shape, the holes 40 of the top panel 32. It is possible that, in nonillustrated embodiments, one or more of the holes 40 and/or 94 may be missing, or have indentations substituted therefor, so as to support a relatively short container, in a carton which also contains one or more vessels which extend substantially the entire vertical dimension of the carton. The shape of the container to be shipped may also be such that one or more of the holes 94 may be of a different shape than the corresponding holes 40, and holes 40 and 94 further may be required to be offset from each other. In the illustrated embodiment, however, holes 94 and 40 are in perpendicular axial alignment with each other so as to receive right cylindrical vessels.

On its end margin opposite score lines 84 and 86, the bottom panel 36 is bounded by a combination of cut lines 96, 98, and 100, as spaced apart by respective fold or score lines 102 and 104. Cut lines 96, 98 and 100 define the outer margins of downwardly extending vertical spacing members, feet or projections 106, 108, and 110, respectively. In the illustrated embodiment, feet 106–110 extend downwardly by a distance equivalent to feet 88, 90 and 92. The feet 106, 108 and 110 are preferably integrally formed extensions of a more or less rectangular main body 112 of the end panel 38.

A cut line 114 defines a notch 116 in the end panel 38 which is sized to receive tab 44 on top panel 32 and also, advantageously, forms a downwardly depending tab 118 on an ear 120. The ear 120 is bounded on its remaining side by a fold or score line 122. An ear 124 is formed in mirror image to ear 120; it is defined by a fold or score line 126 that is formed at right angles to margins 54 and 56, and a horizontal margin 128 which includes a notch 130. The end panel 38 also includes a center slot 132 sized to receive the central flap 146 of panel 132. Likewise, notches 116 and 130 are sized to receive end flaps 44 and 48 of the panel 32. The vertical extent of fold lines 122 and 126 are intended to match the vertical extent of upwardly extending spacing members 70, 72 and 74.

FIG. 3 shows the spacer 30 in an assembled condition. Bottom panel 36 is folded 90° with respect to end panel 38 about fold line 102–104, causing feet 106, 108 and 110 to project downwardly. Fold lines 102 and 104 are preferably collinear, as are fold line pairs 84, 86 and 66, 68. End panel 34 is folded upwardly a further 90° such that bottom feet 92, 90 and 88 will extend downwardly. The top panel 32 is folded yet a further 90° about score lines 66 and 68, leaving behind upwardly extending spacer members or projections 70, 72 and 74.

The end margin 42 of the top panel 32 is secured to the end panel 38 as follows. Tabs 44, 46 and 48 are received within respective slots 116, 132 and 130. Ears 120 and 124 are folded diagonally inwardly at score lines 122 and 126, respectively, and their respective tabs 116 and 130 (see FIG. 2) are inserted into diagonal slots 52 and 50 to complete closure of and lock the structure into an assembled condition. Slots 52 and 50 are positioned so these points of securement are well inward from the end panel 38, but nonetheless spaced away from the holes 40 so as to prevent any occlusion. The inward folding of ears 120 and 124 leaves a remaining center member 134 which extends above the vertical position of top panel 32.

In the assembled condition, panel 38 stands at substantially 90° to panel 32. Ears 120 and 124 provide resistance to any force tending to open the angle between panels 38 and 32. Ears 120 and 124 thereby provide a method of keeping the spacer 30 in an upright condition having a right rectangular section, and do not permit the partial splay or collapse of spacer 30 such that its section become a parallelogram. This makes the spacer 30 more suitable for receiving vessels of liquid, especially heavy ones, as less jostling or manual alignment of the vessels and of the spacer needs to be performed during the packaging process.

Upwardly and downwardly extending members 72, 90 and 108 have been provided such that for any of the four vessels for which this spacer is designed, there will be at least two feet located near the vessel to resist downward force as the vessel is inserted into its respective hole 40 and two upwardly extending members (or one long one) to resist upward movement of the spacer 30 relative to the vessel.

Figure 4:
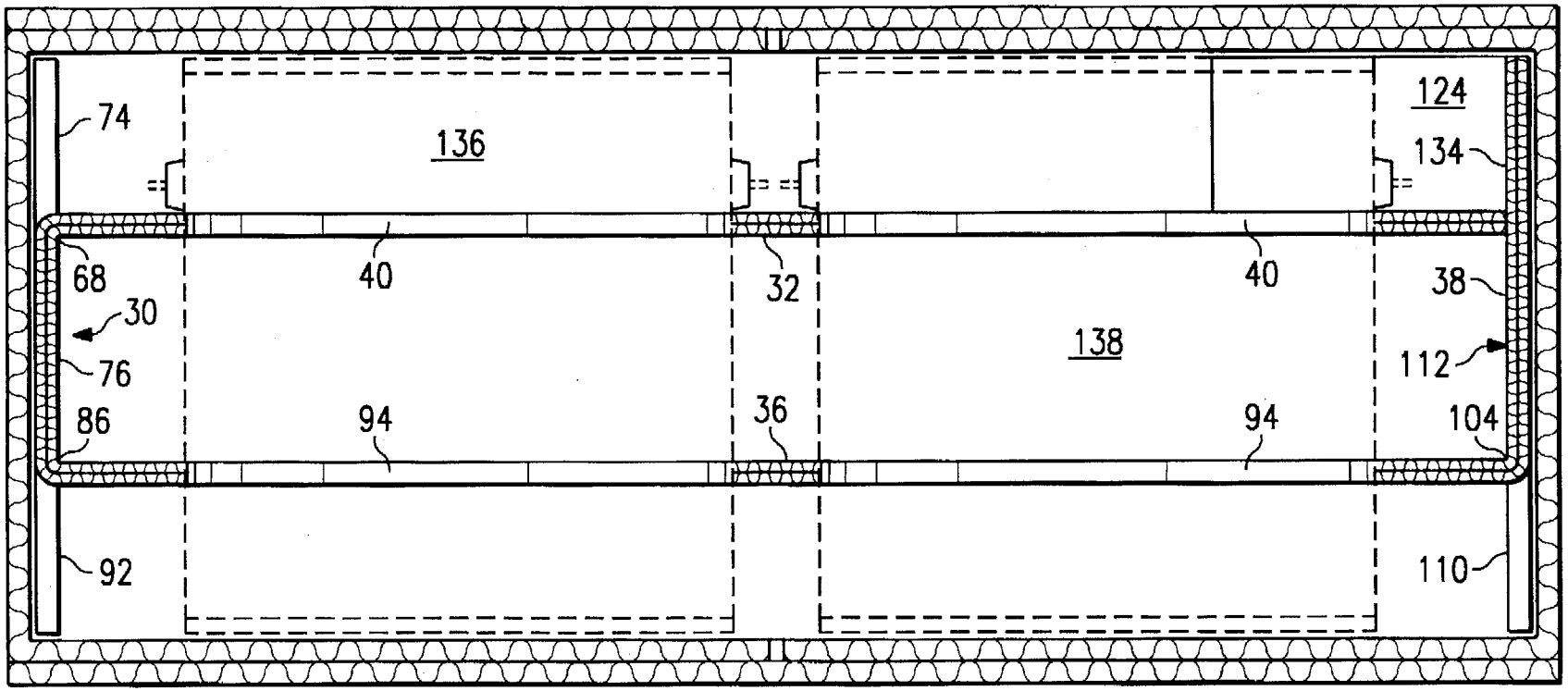
FIG. 4 is an elevational sectional view taken substantially along line 4—4 of FIG. 3, and demonstrating the invention's use to brace cylindrical vessels inside of a shipping canon.

FIG. 4 is a sectional view which illustrates the use of the spacer 30 in a shipment carton, illustrated in phantom. The section is taken along the center line of a pair of holes 40 and an aligned pair of holes 94, and a pair of paint cans 136 and 138 are shown in phantom as occupying these holes. As illustrated, the cans 136 and 138 are spaced away from the sides of the carton and from each other by top and bottom panels 32 and 36. The vertical spacing members 134, 70, 72 (see FIG. 3) and 74 space the top panel from the top of the carton, while the downwardly extending vertical spacing members or feet 88, 90, 92, 106, 108 and 110 (only projections 92 and 110 are shown in this section) space the bottom panel 36 upwardly from the bottom of the shipment carton. The panels 32 and 36 are spaced from each other by the action of the main bodies 76 and 112 of end panels 34 and 38, respectively. In this way, panels 32 and 36 occupy separate vertical positions within the carton and act to brace cans 136 and 138 against lateral forces at these two spaced-apart vertical positions.

Figure 5:
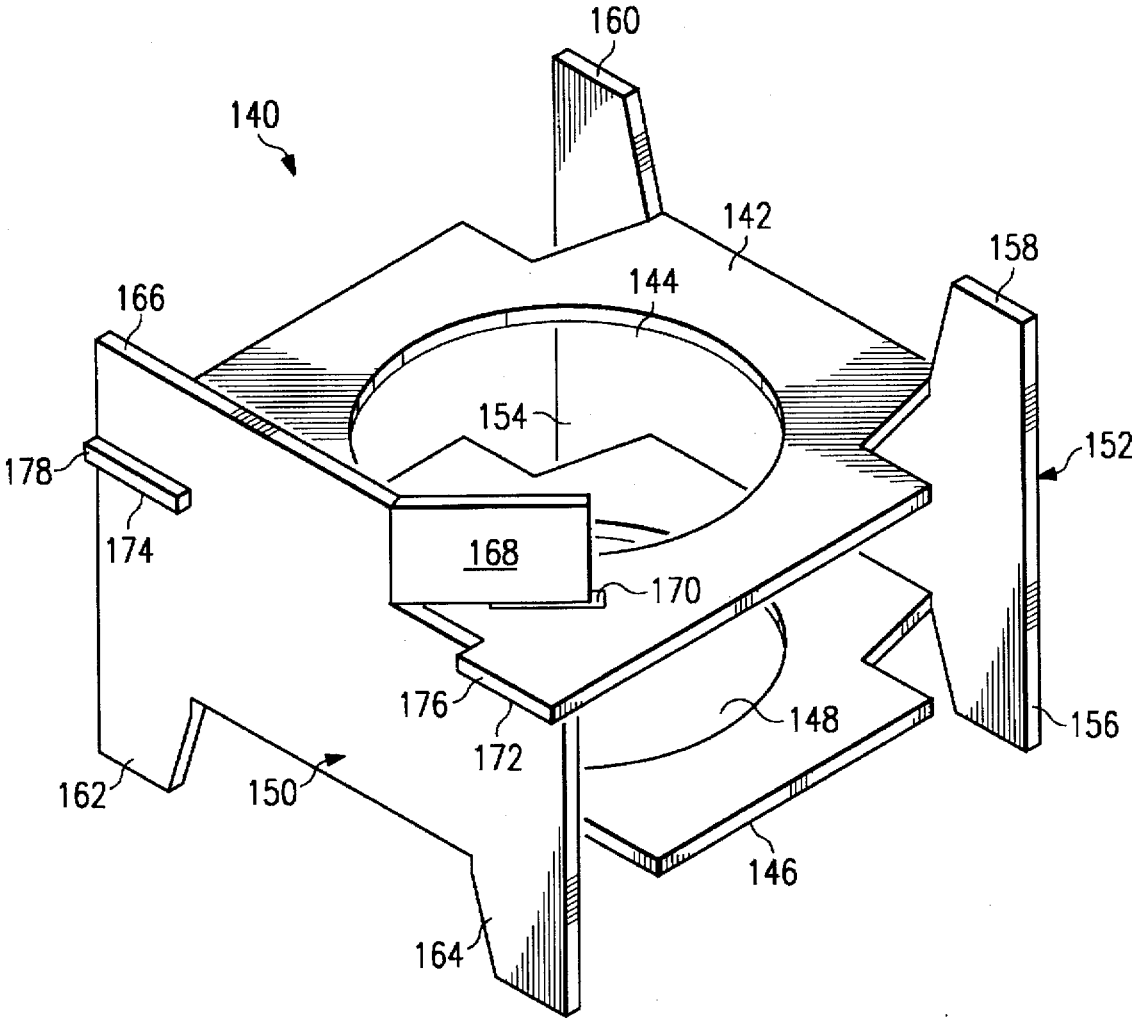
FIG. 5 is a isometric view of a spacer element according to the invention for a single container of hazardous material.

FIG. 5 is an isometric view of a further embodiment of the invention, designed to fit within a shipment cannon for shipping a single container of hazardous fluid material. This spacer unit, indicated generally at 140, has a top panel 142 with a single hole 144 and a bottom panel 146 with a single hole 148. End panels 150 and 152 correspond to end panels 38 and 34 in FIG. 3. The end panel 152 has downwardly extending projections or feet 154 and 156, and upwardly extending vertical spacing members 158 and 160. The other end panel 150 has downwardly extending vertical spacing members or feet 162 and 164 and a single upwardly extending vertical spacing member 166. A single ear 168 has atab (not shown) which is inserted into a single diagonal slot 170 that has beenformed in the top panel 142. End panel 150 has an end margin that includes notches 172 and 174 that receive respective tabs 176 and 178 formed on the end margin of the top panel 142. The spacer 140 acts in a manner similar to spacer 30; horizontal spacing members 142 and 146 are spaced apart from each other andfrom the top and bottom of the carton in which the spacer 140 resides, so as toprovide resistance to lateral movement inside the carton of a single can of fluid material.

The spacers 30 and 140 shown may conveniently be made of 200 pound test 5-ply C-section cardboard, or 380 pound test E-flute cardboard. Other relatively flat, thin and rigid materials may also be used, as long as they (1) are relatively inexpensive, (2) may be easily cut and folded, and (3) meet the minimum strength requirements required for the particular application.

In summary, a novel hazardous fluid container spacer has been shown and described. While preferred embodiments of the invention have been described in the above detailed description and illustrated in the appended drawings, the present invention is not limited thereto but only by the scope and spirit of the appended claims.

What is claimed is:

1. A spacer for containers of hazardous material made of a single sheet of flat, rigid material which has been cut and has been scored for folding, said spacer comprising, in an assembled condition:

a top panel, a number of holes formed in said top panel sized to receive a like number of containers of hazardous material, said top panel having an end margin and a second margin opposite said end margin and being disposed in a first location;

a first end panel joined to said second margin of said top panel, at least one upwardly extending member of said first end panel extending upwardly above said first location, a main body of said first end panel extending downwardly from said first location;

a bottom panel having first and second opposed margins and being disposed in a second location downwardly spaced from said first location, a number of holes in said bottom panel aligned with said holes in said top panel and sized to receive the containers, said first end panel spacing said bottom panel from said top panel, said first end panel joined to said first margin of said bottom panel, at least one downwardly extending member of said first end panel extending downwardly beyond said second location;

a second end panel joined to said second margin of said bottom panel, a main body of said second end panel extending upwardly from said second margin of said bottom panel and acting to space said bottom panel from said top panel, at least one downwardly extending member of said second end panel extending downwardly below said second location, at least one upwardly extending member of said second end panel extending upwardly beyond said first location; and means formed on said upwardly extending member of said second end panel for affixing said end margin of said top panel to said second end panel.

2. The spacer of claim 1, wherein the containers of hazardous material have a height, said top panel disposed to engage sidewalls of the containers at about two-thirds said height, said bottom panel disposed to engage sidewalls of the containers at about one-third said height.

3. The spacer of claim 1, wherein said material is corrugated cardboard.

4. The spacer of claim 1, wherein the shape of said holes formed in said top panel is the same as the shape of said holes formed in said bottom panel.

5. The spacer of claim 4, wherein said holes are circular.

6. The spacer of claim 1, wherein said holes in said top panel and said bottom panel are uniform in size.

7. The spacer of claim 1, wherein said number of holes in said top panel and said number of holes in said bottom panel are selected from the range of one to four, inclusive.

8. The spacer of claim 1, wherein said means for affixing extends over said top panel.

9. The spacer of claim 1, wherein said first end panel has a plurality of upwardly extending members including said at least one upwardly extending member of said first end panel.

10. The spacer of claim 9, wherein said plurality of upwardly extending members consists of either two or three such members.

11. The spacer of claim 1, wherein said first end panel has a plurality of downwardly extending members including said at least one downwardly extending member of said first end panel.

12. The spacer of claim 1, wherein said plurality of downwardly extending members consists of either two or three such members.

13. The spacer of claim 1, wherein said at least one upwardly extending member of second end panel is the only upwardly extending member of said second end panel.

14. The spacer of claim 1, wherein said second end panel has a plurality of downwardly extending members including said at least one downwardly extending member of said second end panel.

15. The spacer of claim 1, wherein said plurality of downwardly extending members consists of either two or three such members.

16. A spacer for one or more objects to be shipped inside of a shipping carton, said spacer adaptable to be assembled by an end user from a single sheet of cut and scored, relatively rigid, flat and thin material and comprising, in an assembled condition:

a bottom panel and a top panel each having first and second opposed ends and a pair of side margins connecting said ends, a plurality of holes each sized to receive an object, said holes spaced inwardly from said ends and said side margins, said holes in said top panel being in alignment with said holes in said bottom panel, said top panel disposed at a first vertical location, said bottom panel disposed at a second vertical location spaced below said first vertical location;

first and second end panels disposed substantially vertically, each of said end panels having a plurality of projections extending above said first vertical location and extending below said second vertical location so as to space said top panel from a top of the shipping carton and to space said bottom panel from a bottom of the shipping carton, said first end panel joining said first ends of said top and bottom panels, said second end panel joining said second ends of said top and bottom panels; and said projections including an upward projection of said second end panel which extends upwardly beyond said first vertical location, ears of said upward projection connected to a remainder of said upward projection by respective substantially vertically oriented score lines, said ears folded inwardly over said top panel, slots formed in said top panel engaging said ears to join said second end panel to said top panel.

17. A spacer for bracing one or more objects inside of a shipping carton, said spacer being integrally formed from a single sheet of cut and scored, relatively flat and thin material and comprising, in an assembled condition:

a bottom panel and a top panel each having first and second opposed ends and a pair of side margins connecting said ends, said top panel and said bottom panel each having a plurality of object-engaging features each sized to receive an object to be braced inside of said shipping carton, said top panel disposed at a first vertical location, said bottom panel disposed at a second vertical location spaced below said first vertical location;

first and second end panels disposed substantially vertically, each of said end panels having a plurality of projections extending above said first vertical location and extending below said second vertical location so as to space said top panel from a top of the shipping carton and to space said bottom panel from a bottom of the shipping carton, said first end panel joining said first ends of said top and bottom panels, said second end panel joining said second ends of said top and bottom panels; and said projections including an upward projection of said second end panel which extends upwardly beyond said first vertical location, at least one portion of said upward projection disposed over and engaging said top panel so as to lock said spacer into an assembled condition.

18. The spacer of claim 17, wherein said at least one portion of said upward projection is one of two such portions disposed over and engaging said top panel.

19. The spacer of claim 17, wherein said at least one portion forms a comer of said second end panel.

20. The spacer of claim 17, wherein said panels are substantially rectangular.

21. The spacer of claim 17, wherein said top panel has formed thereon at least one slot, a downwardly projecting tab formed on said at least one portion of said upward projection of said second end panel received in said slot.

22. The spacer of claim 21, wherein said second end of said top panel has a number of laterally extending tabs for joining with said second end panel, said second end panel including a body spacing said top panel from said bottom panel and said upward projection of said second end panel, said upward projection of said upward end panel formed as an integral extension from said body of said end panel;

a cut line dividing said at least one portion of said upward projection of said second end panel from said body of said second end panel when said spacer is in an unassembled condition, a notch in said cut line sized so as to form a notch on said body of said second end panel which is sized to receive one of said tabs formed on said second end of said top panel, said notch of said cut line at the same time forming said downwardly projecting tab of said at least one portion of said upward projection of said second end panel.

* * * * *